US008277249B2

(12) United States Patent
Koga

(10) Patent No.: US 8,277,249 B2
(45) Date of Patent: Oct. 2, 2012

(54) CONTACT FOR COAXIABLE CABLE HAVING A TEARABLE BAND BETWEEN A CONDUCTOR BARREL AND A CRIMP BARREL

(75) Inventor: Shinichi Koga, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 13/166,462

(22) Filed: Jun. 22, 2011

(65) Prior Publication Data

US 2011/0318960 A1 Dec. 29, 2011

(30) Foreign Application Priority Data

Jun. 23, 2010 (JP) ..... 2010-143093

(51) Int. Cl.
*H01R 9/05* (2006.01)
*H01R 43/04* (2006.01)

(52) U.S. Cl. ..... 439/585; 29/867

(58) Field of Classification Search ..... 439/578, 439/585, 301, 442; 29/867
See application file for complete search history.

(56) References Cited

U.S. PATENT DOCUMENTS

| | | | | |
|---|---|---|---|---|
| 6,808,417 | B2 * | 10/2004 | Yoshida | 439/585 |
| 7,115,006 | B2 * | 10/2006 | Onuma | 439/881 |
| 7,160,150 | B2 * | 1/2007 | Annequin | 439/585 |
| 7,198,509 | B2 * | 4/2007 | Takasu | 439/485 |
| 7,422,480 | B1 * | 9/2008 | Musick et al. | 439/585 |

FOREIGN PATENT DOCUMENTS

| | | |
|---|---|---|
| JP | 06-068939 | 3/1994 |
| JP | 2003-257560 | 9/2003 |
| JP | 2003-297493 | 10/2003 |
| JP | 2003-317882 | 11/2003 |
| JP | 2006-302824 | 11/2006 |
| JP | 2006-310135 | 11/2006 |
| JP | 2006-318788 | 11/2006 |
| JP | 2009-187826 | 8/2009 |
| JP | 2009-266452 | 11/2009 |
| JP | 2010-0033726 | 2/2010 |

* cited by examiner

*Primary Examiner* — Chandrika Prasad
(74) *Attorney, Agent, or Firm* — Jordan and Hamburg LLP

(57) ABSTRACT

A contact for coaxial cable attached to an end of a coaxial cable includes a contact part and a connection part. The connection part includes a conductor barrel, an open crimp barrel, and a junction band narrow in width. The conductor barrel is disposed on a side to a base end portion of the contact part and can crimp the inner conductor. The open crimp barrel is adjacent to the conductor barrel and can crimp an exposed portion of the dielectric body so as to surround the exposed portion of the dielectric body in a cylindrical shape. The junction band joins the conductor barrel with the open crimp barrel so as to bridge the two. The both end portions of the junction band are torn during or after crimping of the conductor barrel and the open crimp barrel.

6 Claims, 5 Drawing Sheets

CONTACT FOR COAXIABLE CABLE HAVING A TEARABLE BAND BETWEEN A CONDUCTOR BARREL AND A CRIMP BARREL

This application is based on and claims the benefit of priority from Japanese Patent Application No. 2010-143093, filed on 23, Jun. 2010 the content of which is incorporated herein by reference.

BACKGROUND OF THE INVENTION

1. Field of the Invention

The present invention is related to a contact for coaxial cable and an end processing method for coaxial cable. Particularly, the present invention relates to a structure of a contact for crimping an inner conductor and a dielectric body provided in a coaxial cable, and an end processing method of coaxial cable using the contact.

2. Related Art

A coaxial cable is an unbalanced shielded wire with characteristic impedance being defined for transmitting an electronic signal. The coaxial cable is characterized by preventing electromagnetic wave leakage to the outside and allowing bend to a certain extent, and is used as a feeder cable that connects a TV receiver, a radio or the like with an antenna.

In the coaxial cable, an inner conductor disposed in a central portion is covered with a dielectric body (insulating body) such as polyethylene. The dielectric body is covered with an outer conductor composed of braided wire, and the outer conductor is further covered with a sheath (protection covering).

In a case of connecting a contact to an end of such a coaxial cable, the contact is electrically connected to the outer conductor using an outer conductor contact having a conductor barrel that crimps the outer conductor and an insulation grip that crimps the sheath.

If a crimping force is high in a case of crimping the outer conductor by the conductor barrel, the conductor is deformed to be squashed and this affects impedance fluctuation during transmission of an electronic signal.

On the other hand, if a crimping force is low in a case of crimping the outer conductor by the conductor barrel, fixing strength between the outer conductor contact and the coaxial cable lowers and this may cause relative drop-off when a tensile force in a direction of separating the outer conductor contact and the coaxial cable is applied.

In order to prevent the abovementioned problems, for example Japanese Patent Application Publication No. 2006-302824 (hereinafter referred to as Patent Document 1) discloses a connector for coaxial cable having an outer conductor contact for crimping an outer conductor by a conductor barrel, in which a cylindrical metallic sleeve is applied to a dielectric body, covered with the outer conductor, and crimped by the conductor barrel.

The sleeve disclosed in Patent Document 1 is characterized in having a portion in which a first end edge of the abutting end edges being a joint in a circumference direction is formed to be a tapered face inclined in a diameter direction so as to climb over the other end edge and a portion which is formed to be a tapered face inclined in a diameter direction so as to slide under a second end edge, in a mixed manner, and the second end edge opposed to the first end edge is formed to be an inverse-tapered face so that it may slide along this tapered face.

Patent Document 1 discloses that such a sleeve can prevent deformation of a coaxial cable for high frequency wave when the outer conductor contact is connected to the coaxial cable, and can provide superior high-frequency response, high wire-fixing strength, and superior electrical connection.

According to a first embodiment of Patent Document 1, an inner conductor contact (inner conductor terminal 20), an outer conductor contact (outer conductor terminal 50), and a sleeve (cylindrical sleeve 30) are configured separately, thereby prolonging end processing step (fabrication time) of the coaxial cable. As a result, it is difficult to reduce production cost of a so-called wiring harness, in which connectors for coaxial cable are attached to ends of a coaxial cable.

According to a second embodiment of Patent Document 1, although an outer conductor contact (outer conductor terminal 51) and a sleeve (cylindrical sleeve 30) are integrally composed, a shell (separate shielding member 58 with a shield conductor crimp part 54 and a sheath crimp part 56) is required for connecting the outer conductor contact (outer conductor terminal 51) and a braided wire (shield conductor 16).

As a result, as in the first embodiment, it is difficult to reduce production cost of a so-called wiring harness, in which connectors for coaxial cable are attached to ends of a coaxial cable.

In addition, in the first and second embodiments of Patent Document 1, since the inner conductor contact (inner conductor terminal 20) and the sleeve (cylindrical sleeve 30) are configured to be separately attached, an attachment position, relative to the inner conductor contact, of the sleeve to the dielectric body (insulating body 14) is uncertain. If the sleeve cannot be attached to a specific position relative to the inner conductor contact and dislocation variation is great, a voltage standing wave ratio (VSWR), which is a designed value, varies due to signal reflection. If the VSWR is high, transmission failure such as noise may be caused on a reception side.

SUMMARY OF THE INVENTION

The present invention is made in view of the abovementioned problem and aims at providing a contact for coaxial cable and end processing method that can shorten an end processing step of a coaxial cable and can suppress variation of VSWR.

In a first aspect of the present invention, a contact for coaxial cable that is attached to an end of a coaxial cable includes: an inner conductor disposed in a central portion; a dielectric body that covers the inner conductor; braided wire that covers the dielectric body; and a sheath that covers the braided wire, the contact including: a contact part that is connected to a contact of a corresponding part; and an elongated connection part that extends from a base end portion of the contact part and is connected to the end of the coaxial cable, in which the connection part includes: a conductor barrel that is disposed on a side to the base end portion of the contact part and open in a U-shape that can crimp the inner conductor; an open crimp barrel that is adjacent to the conductor barrel and open in a U-shape that can crimp an exposed portion of the dielectric body so as to surround the exposed portion of the dielectric body in a cylindrical shape; and a junction band that is narrow in width and joins a part of an end edge of the conductor barrel with a part of an end edge of the open crimp barrel so as to form a bridge, and wherein the junction band is formed such that both end portions thereof are tearable during or after crimping of the conductor barrel and the open crimp barrel, so as to separate the conductor barrel and the open crimp barrel.

The "barrel" of the conductor barrel and the open crimp barrel disclosed in the first aspect indicates a crimp portion for constituting a contact, and "crimping of . . . barrel" indicates plastic deformation by shaping the barrel for obtaining superior connection. In the first aspect, the conductor barrel is crimped to the inner conductor, thereby holding the conductor barrel on the inner conductor and making the conductor barrel electrically connectable to the inner conductor. Accordingly, the open crimp barrel is crimped to the dielectric body, thereby holding the open crimp barrel to the dielectric body.

In the contact for coaxial cable according to the first aspect, a distance between the conductor barrel and the open crimp barrel is defined by a junction band. Therefore, the distance therebetween is maintained even if the junction band is torn after crimping of the conductor barrel and the open crimp barrel.

In a second aspect of the present invention, an end processing method for coaxial cable for attaching a contact for coaxial cable to an end of a coaxial cable, the coaxial cable including: an inner conductor disposed in a central portion; a dielectric body that covers the inner conductor; braided wire that covers the dielectric body; and a sheath that covers the braided wire, includes: a contact part that is connected to a contact of a corresponding part; and an elongated connection part that extends from a base end portion of the contact part and is connected to the end of the coaxial cable, in which the connection part includes: a conductor barrel that is disposed on a side to the base end portion of the contact part and open in a U-shape that can crimp the inner conductor; an open crimp barrel that is adjacent to the conductor barrel and open in a U-shape that can crimp an exposed portion of the dielectric body so as to surround the exposed portion of the dielectric body in a cylindrical shape; and a junction band that joins a part of an end edge of the conductor barrel with a part of an end edge of the open crimp barrel so as to bridge, the end processing method comprising: a cutting and peeling step of measuring the coaxial cable, cutting the end of the coaxial cable, and peeling the dielectric body, the braided wire, and the sheath in a stepped manner, from an end face of the inner conductor to predetermined lengths; a braided wire folding step of folding back the braided wire so as to cover the sheath; and a crimping and cutting step of cutting both end portions of the junction band during or after crimping of the conductor barrel and the open crimp barrel, so as to separate the conductor barrel and the open crimp barrel.

The end processing method for coaxial cable as described in the second aspect further includes: a braided wire recovery step of covering the open crimp barrel in the cylindrical shape, which has been crimped, with the braided wire; and an outer conductor contact attaching step of, using an outer conductor contact having a first crimp part and a second crimp part, crimping the open crimp barrel, which has been crimped over the braided wire, with the first crimp part and the sheath with the second crimp part.

In the contact for coaxial cable according to the present invention, the inner conductor contact, including the contact part and the conductor barrel, and the sleeve for protecting the dielectric body from deformation (after crimping of the open crimp barrel thereto) are integrally configured. As a result, at least any one of ease, reliability and accuracy of attachment to the coaxial cable can be increased. In addition, the contact for coaxial cable according to the present invention contributes to a shorter end processing step (processing time) of coaxial cable and reduction of production cost of a wiring harness.

DETAILED DESCRIPTION OF THE INVENTION

In the present invention, the inner conductor contact for crimping the inner conductor of a coaxial cable and the open crimp barrel for crimping the dielectric body of the coaxial cable are integrally configured. When the open crimp barrel is crimped to the dielectric body of the coaxial cable, the sleeve that has been crimped is separated from the inner conductor contact such that the sleeve in a state of being covered with the braided wire functions as a sleeve for protecting the dielectric body when a braided wire is crimped. Such a configuration can solve the abovementioned problem. A preferred mode for carrying out the present invention is described hereinafter with reference to drawings.

Configuration of Contact for Coaxial Cable

Figure 1:
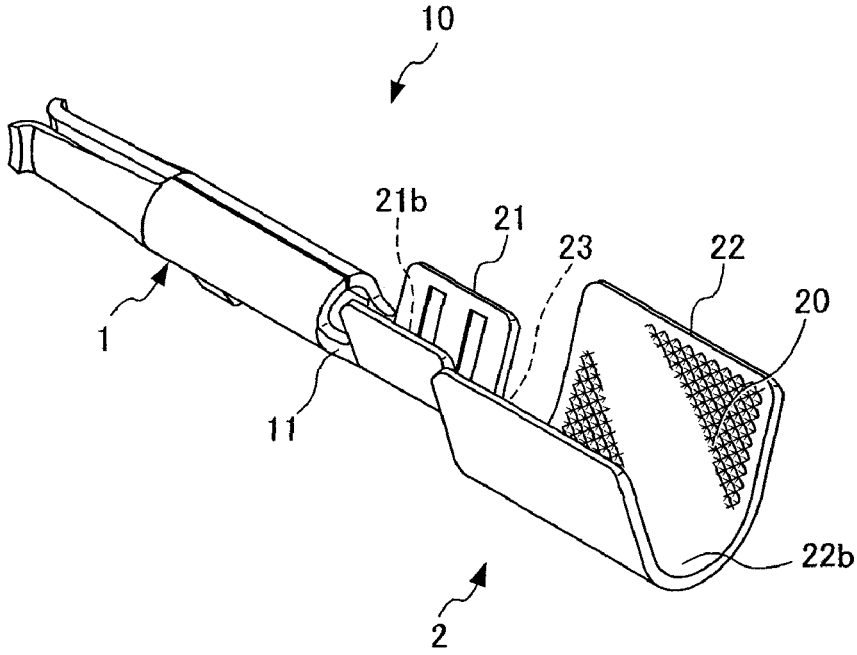
FIG. 1 is a perspective view showing a configuration of a contact for coaxial cable according to an embodiment of the present invention.
Figure 2:
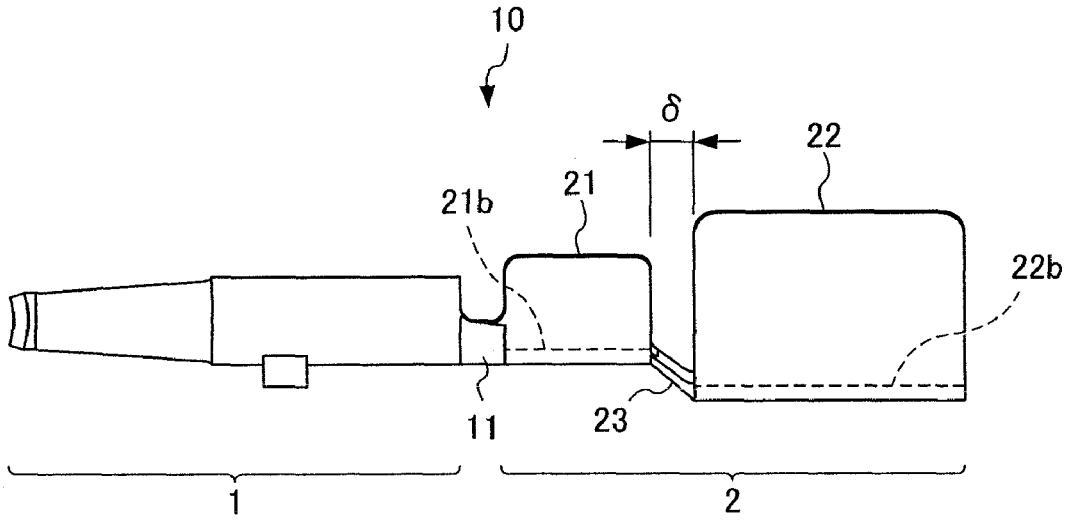
FIG. 2 is a front view showing the contact for coaxial cable according to the embodiment.

First, a configuration of a contact for coaxial cable according to an embodiment of the present invention is described. FIG. 1 is a perspective view showing a configuration of a contact for coaxial cable according to an embodiment of the present invention. FIG. 2 is a front view showing the contact for coaxial cable according to the embodiment.

Figure 3A:
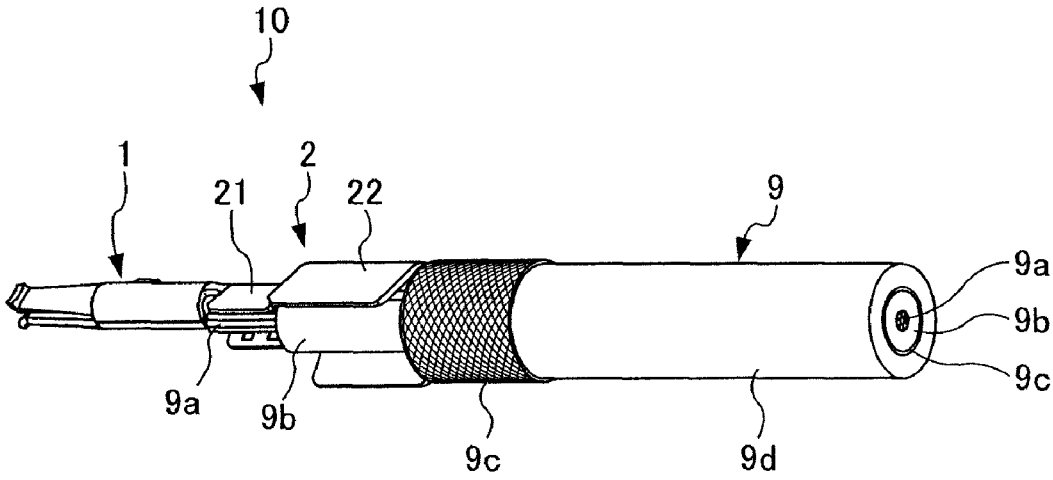
FIG. 3A is a perspective view showing a configuration of the contact for coaxial cable according to the embodiment in a state before crimping the contact for coaxial cable to an end of a coaxial cable.
Figure 3B:
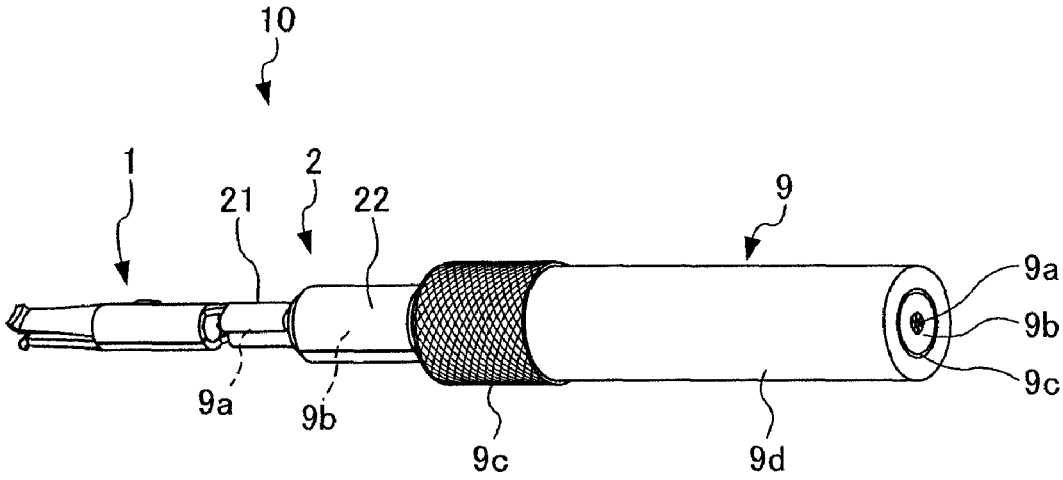
FIG. 3B is a perspective view showing a configuration of the contact for coaxial cable according to the embodiment in a state after crimping the contact for coaxial cable to an end of a coaxial cable.

FIGS. 3A and 3B are perspective views showing a configuration of the contact for coaxial cable according to the embodiment, FIG. 3A showing a state before crimping the contact for coaxial cable to an end of a coaxial cable and FIG. 3B showing a state after crimping the contact for coaxial cable to an end of a coaxial cable.

Figure 4A:
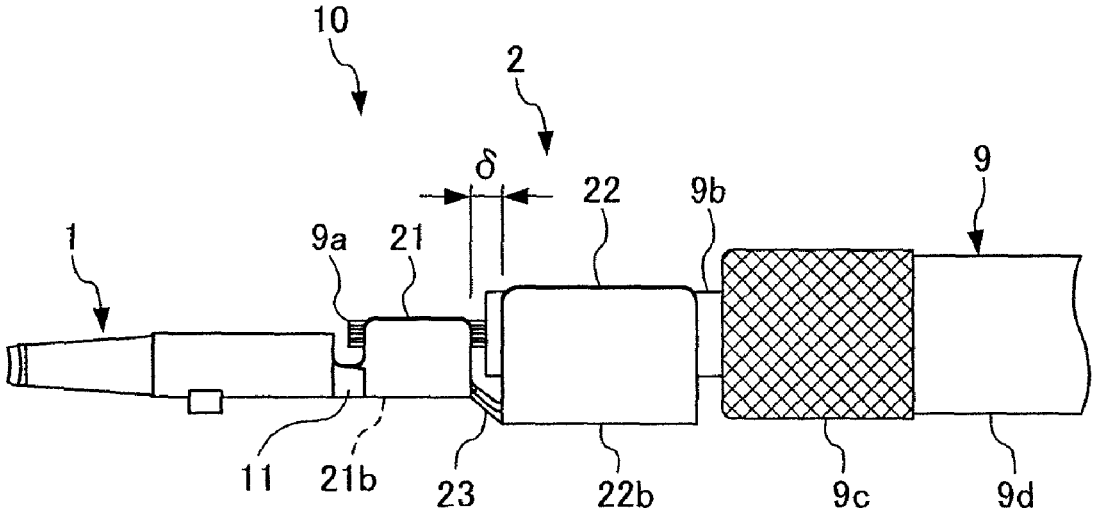
FIG. 4A is a front view showing the contact for coaxial cable according to the embodiment in a state before crimping the contact for coaxial cable to an end of a coaxial cable.
Figure 4B:
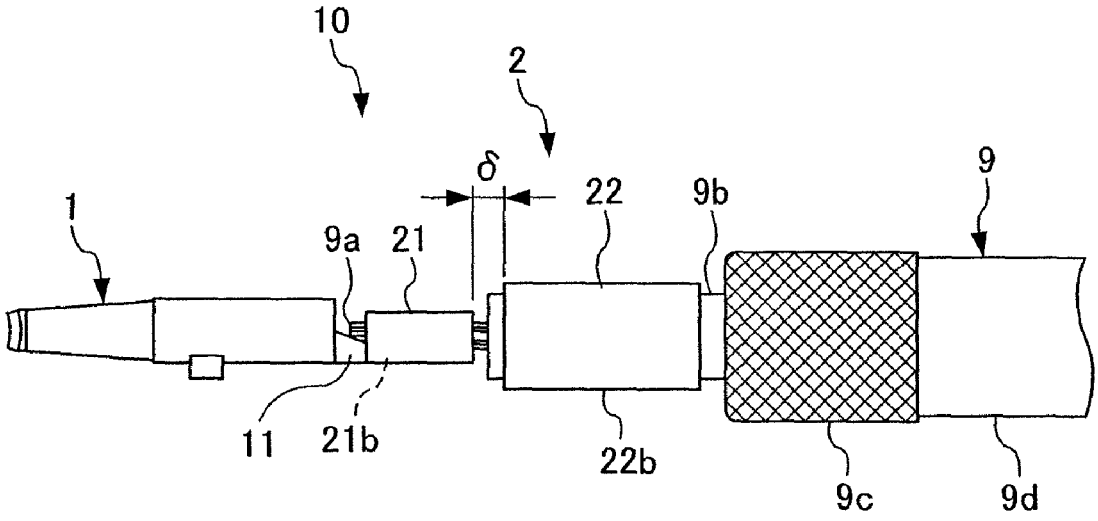
FIG. 4B is a front view showing the contact for coaxial cable according to the embodiment in a state after crimping the contact for coaxial cable to an end of a coaxial cable and removing a junction band.

FIGS. 4A and 4B are front views showing the contact for coaxial cable according to the embodiment, FIG. 4A showing a state before crimping the contact for coaxial cable to an end of a coaxial cable and FIG. 4B showing a state after crimping the contact for coaxial cable to an end of a coaxial cable and removing the junction band.

With reference to FIGS. 1 to 4A, 4B, a contact for coaxial cable 10 according to the embodiment of the present invention is attached to a terminal of a coaxial cable 9. This includes both mechanically connecting and electrically connecting the contact for coaxial cable 10 (hereinafter referred to as first contact) and the coaxial cable 9. The coaxial cable 9 includes an inner conductor 9*a*, a dielectric body 9*b*, a braided wire 9*c*, and a sheath 9*d*. The inner conductor 9*a* is disposed in a central portion of the coaxial cable 9. The dielectric body 9*b* covers the inner conductor 9*a*. The braided wire 9*c* covers the dielectric body 9*b*. The sheath 9*d* covers the braided wire 9*c*. In FIGS. 3A, 3B, 4A and 4B, the coaxial cable 9 is shown in a state in which the braided wire 9*c* is folded back to a side of the sheath 9*d*.

The inner conductor 9*a* is also called a central conductor, and can be either a single wire or a stranded wire of a plurality of fine wires. As the dielectric body 9*b*, polyethylene is generally used; however, foamed resin can also be used depending on a use. The dielectric body 9*b* is a nonconductive insulating body having predetermined relative permittivity. Characteristic impedance can be obtained from a cross-sectional shape and relative permittivity of the coaxial cable.

The braided wire 9*c* is a plurality of fine copper wires braided in a cylindrical shape and can be expanded in diameter to a predetermined extent, therefore can be folded back to the side of the sheath 9*d*. The sheath 9*d* is an insulating body covering the braided wire 9*c*, and can be composed of an insulating material such as polyvinyl chloride, polyethylene, fluorine resin and the like.

A developed conductive metal plate is preferably formed as the first contact (contact for coaxial cable) 10. For the developed metal plate, as a nonlimiting example, copper alloy is preferably used from a viewpoint of conductivity.

With reference to FIG. 1 or 2, the first contact 10 includes a contact part 1 and an elongated connection part 2. The contact part 1 is connected to a contact of a corresponding part (not illustrated). The connection part 2 extends from a base end portion of the contact part 1 via a base end extended portion 11. The connection part 2 is connected to an end of the coaxial cable 9 (see FIGS. 3A and 3B or FIGS. 4A and 4B).

With reference to FIGS. 1 to 4A, 4B, the connection part 2 includes a conductor barrel 21 that is open in a U-shape, an open crimp barrel 22 that is open in a U-shape, and a junction band 23 narrow in width. The junction band 23 is a bridging part in a thin belt shape that is narrower in width than the base end extending portion 11, for example. The conductor barrel 21 is disposed from the base end portion of the contact part 1 via the base end extended portion 11. The conductor barrel 21 can crimp the inner conductor 9*a*.

With reference to FIGS. 1 to 4A, 4B, the open crimp barrel 22 is adjacent to the conductor barrel 21. In addition, the open crimp barrel 22 can crimp an exposed portion of the dielectric body so as to surround the exposed portion of the dielectric body in a cylindrical shape.

With reference to FIG. 2 or 4A, the junction band 23 joins a part of an end edge of the conductor barrel 21 with a part of an end edge of the open crimp barrel 22 that is adjacent thereto, so as to bridge the two. In other words, the junction band 23 joins a bottom portion 21*b* of the U-shape of the conductor barrel 21 with a bottom portion 22*b* of the U-shape of the open crimp barrel 22, so as to bridge the two. In addition, the junction band 23 is formed such that both end portions thereof are tearable during or after crimping of the conductor barrel 21 and the open crimp barrel 22, so as to separate the conductor barrel 21 and the open crimp barrel 22.

As shown in FIG. 4B, in the first contact 10, after crimping the conductor barrel 21 and the open crimp barrel 22 and tearing (removing) the junction band 23, the conductor barrel 21 functions as a contact for the inner conductor and the open crimp barrel 22 functions as a sleeve for protecting the dielectric body from deformation.

With reference to FIGS. 1 to 4A, 4B, the first contact 10 according to the present embodiment is formed by shaping a developed conductive metal plate (not illustrated). The contact part 1 is a female contact that accepts a pin-shaped male contact of the corresponding part and electrically connects thereto in an inner face thereof, in which a base end side thereof is formed in a cylindrical shape and an apex portion thereof is bifurcated. However, the contact part 1 is not limited to the female contact. A male contact that is inserted into a female contact of the other side and electrically connects thereto on an outer face thereof can be provided as the contact part 1.

With reference to FIG. 1, the open crimp barrel 22 is preferably provided with a drop-off preventing means 20, which prevents drop-off from the dielectric body 9*b*, on an inner wall thereof. The drop-off preventing means 20 can be a diamond-cut pattern (partially illustrated) obtained by knurling processing, or a streaky pattern with concave and convex portions obtained by serration processing (not illustrated) for increasing friction coefficient with respect to the dielectric body 9*b*.

In addition, with reference to FIG. 1, the drop-off preventing means 20 can include a boss (not illustrated) that projects from an inner wall of the open crimp barrel 22 and a dimple (not illustrated) that is provided in the inner wall of the open crimp barrel 22.

End Processing Method of Coaxial Cable

First, steps for processing an end of a coaxial cable using the first contact 10 according to the present embodiment are described. FIGS. 5A to 5E are diagrams showing steps for processing an end of a coaxial cable according to an embodiment of the present invention.

Figure 5A:
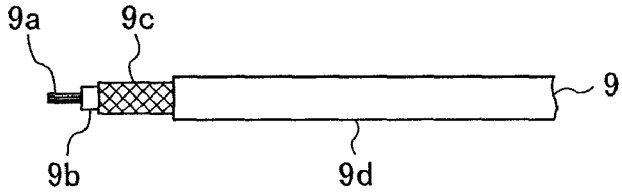
FIGS. 5A to 5E are diagrams showing steps for processing an end of a coaxial cable according to an embodiment of the present invention.

First, with reference to FIG. 5A, the coaxial cable 9 is measured in length and an end thereof is cut (measuring and cutting step). Next, the dielectric body 9*b*, the braided wire 9*c*, and the sheath 9*d* are peeled in a stepped manner, from an end face of the inner conductor 9*a* to predetermined lengths (cutting and peeling step). The inner conductor 9*a* and the braided wire 9*c* are thus exposed.

Figure 5B:
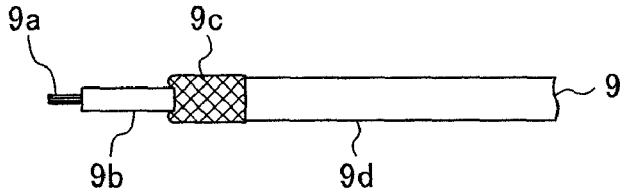

Subsequently, as shown in FIG. 5B, the braided wire 9*c* is folded back so as to cover the sheath 9*d* (braided wire folding step).

Figure 5C:
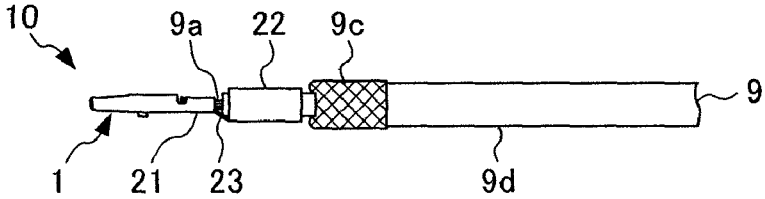

Thereafter, as shown in FIG. 5C, using the open crimp barrel 22, which is integrally composed with the conductor barrel 21 of the contact part 1 by means of the junction band 23, the conductor barrel 21 is crimped to the inner conductor 9*a* and the open crimp barrel 22 is crimped to the dielectric body 9*b*. And then, both end portions of the junction band 23 are torn during or after crimping of the conductor barrel 21 and the open crimp barrel 22, so as to separate the conductor barrel 21 and the open crimp barrel 22 (crimping and cutting step). The junction band 23 is thus removed.

Figure 5D:
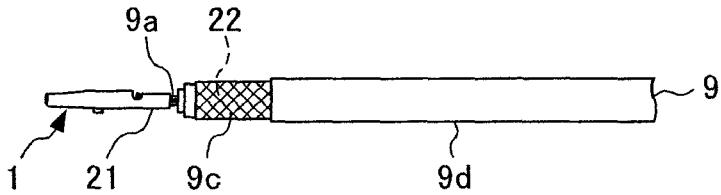

Next, as shown in FIG. 5D, the open crimp barrel 22 in the cylindrical shape, which has been crimped, is covered with the braided wire by recovering the braided wire 9*c* (braided wire recovery step).

Figure 5E:
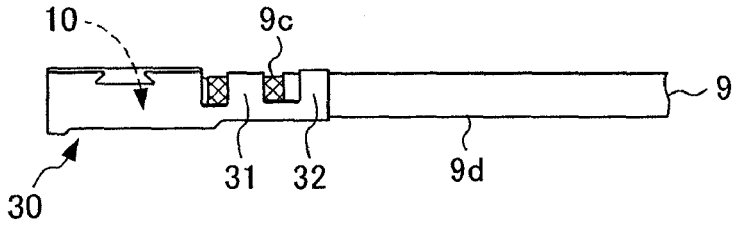

Subsequently, as shown in FIG. 5E, using an outer conductor contact (hereinafter referred to as a second contact) having a first crimp part 31 and a second crimp part 32, the open crimp barrel 22, which has been crimped over the braided wire 9*c*, is crimped with the first crimp part 31 and the sheath 9*d* is crimped with the second crimp part 32 (outer conductor contact attaching step).

In FIG. 5E, the first contact 10 and the second contact 30 are joined to each other by means of a dielectric body cylinder (housing) which is not illustrated. As a result of such a series of steps, the connector for coaxial cable, including the first contact 10 and the second contact 30, can be connected to an end of the coaxial cable 9.

Function of Contact for Coaxial Cable

Next, function and effect of the first contact 10 according to the present embodiment are described.

With reference to FIG. 1 or 2, the first contact 10 is generally a linked contact in which the open crimp barrel 22 is linked to a carrier in a band plate shape (not illustrated). In addition, the first contact 10 that is linked is wound around a reel (not illustrated) along with the carrier.

The conductor barrel 21 and the open crimp barrel 22 are crimped to the first contact 10 with the carrier that is unreeled from the reel, using an automatic crimping machine (not illustrated) (see FIG. 5C). In addition, as shown in FIG. 5C, both end portions of the junction band 23 are torn during or after crimping of the conductor barrel 21 and the open crimp barrel 22, by a tearing tool provided in the automatic crimping machine. The first contact 10 is then separated from the carrier.

As described above, the first contact 10 according to the present embodiment is suitable for crimping by the automatic crimping machine. By using the automatic crimping machine, the both end portions of the junction band 23 can be immediately torn during or after crimping of the conductor barrel 21 and the open crimp barrel 22. This can improve productivity of a wiring harness.

In general, a crimping contact for crimping wires (including coaxial cables) is configured such that a conductor barrel and an open crimp barrel are difficult to separate. On the other hand, with reference to FIG. 1 or 2, the first contact 10 according to the present embodiment is configured such that the both end portions of the junction band 23, which join the conductor barrel 21 and the open crimp barrel 22, are tearable.

With reference to FIGS. 4A and 4B, in the first contact 10 according to the present embodiment, after separation of the conductor barrel 21 and the open crimp barrel 22, the open crimp barrel 22, which has crimped the dielectric body 9*b* so as to surround the dielectric body 9*b* in a cylindrical shape, functions as a sleeve for protecting the dielectric body 9*b* from deformation.

With reference to FIGS. 4A and 5C, in the first contact 10 according to the present embodiment, the inner conductor contact, including the contact part 1 and the conductor barrel 21, and the sleeve for protecting the dielectric body 9*b* from deformation are integrally configured, thereby facilitating attachment to the coaxial cable 9.

For example, in Patent Document 1, an inner conductor contact (inner conductor terminal 20) and a sleeve (cylindrical sleeve) are crimped separately. On the other hand, in the present invention, the conductor barrel 21 (inner conductor contact) and the open crimp barrel 22 (sleeve) are crimped at the same time as shown in FIGS. 4A and 5C, thereby shortening the end processing step (processing time) of the coaxial cable 9.

As described above, the first contact 10 according to the present embodiment can shorten the end processing step (processing time) of the coaxial cable 9. The first contact 10 according to the present embodiment can thus contribute to reduction of production cost of a wiring harness.

Figure 6A:
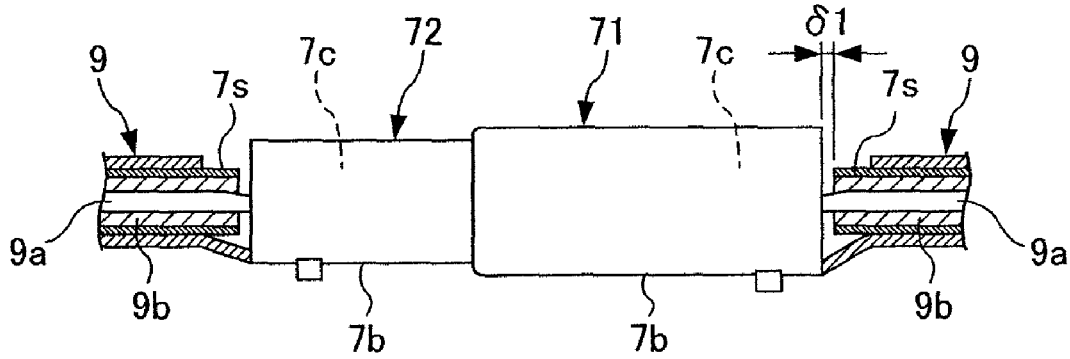
FIGS. 6A and 6B are front views of a state in which a receptacle (dielectric body cylinder) and a plug are connected, for describing a problem in a case of variation of distance between an end face of a sleeve and an end face of the receptacle.
Figure 6B:
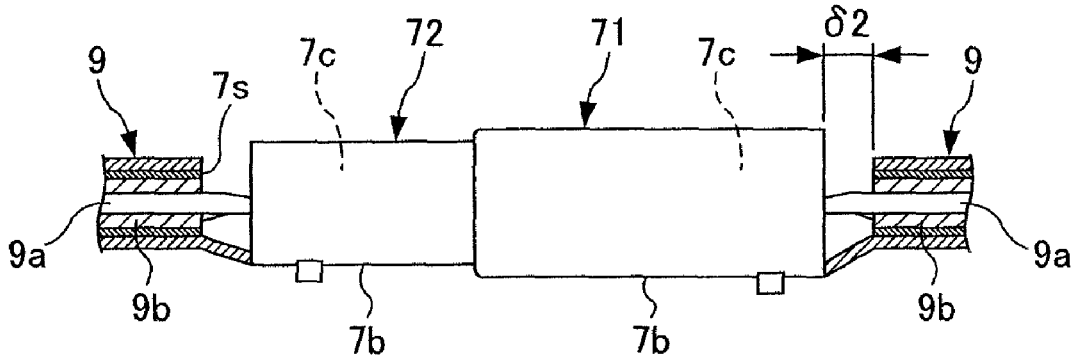

FIGS. 6A and 6B are front views of a state in which a receptacle (dielectric body cylinder) 71 and a plug (connector for coaxial cable) 72 are connected in the same configuration as in Patent Document 1. With reference to FIG. 6A, in the receptacle 71, a sleeve 7*s* projects from a crimp part of an outer conductor contact 7*b*. A distance between an end face of the sleeve 7*s* and an end face of the receptacle 71 (dielectric body cylinder 7*c*) is δ1.

On the other hand, with reference to FIG. 6B, in the receptacle 71, the sleeve 7*s* is substantially aligned with an end face of the crimp part of the outer conductor contact 7*b*. A distance between the end face of the sleeve 7*s* and the end face of the receptacle 71 (dielectric body cylinder 7*c*) is δ2. Here, δ2>δ1.

When a high-frequency signal (traveling wave) of a several GHz bandwidth is sent (transmitted) to the coaxial cable 9 shown in FIGS. 6A and 6B, signal reflection (reflected wave) is generated due to a slight mismatch of impedance between the coaxial cable 9 and the receptacle 71. In other words, Voltage Standing Wave Ratio (VSWR) is at least 1. In general, VSWR is ideally no greater than 1.5, and a practical limit thereof is no greater than 3. A high VSWR value may cause transmission failure such as noise on a reception side.

Comparing FIG. 6A with FIG. 6B, when a high-frequency signal of approximately 4 GHz is transmitted to the coaxial cable 9, VSWR is better in a state of FIG. 6B than in a state of FIG. 6A. In other words, VSWR depends on the distance δ between the end face of the sleeve 7*s* and the end face of the receptacle 71 (dielectric body cylinder 7*c*), and variation of the distance δ causes instability of VSWR.

With reference to FIG. 4A, the first contact 10 according to the present embodiment is configured such that the conductor barrel 21 and the open crimp barrel 22 are joined by the junction band 23 so as to have a distance defined by δ.

With reference to FIG. 4B, in the first contact 10 according to the present embodiment, even if the junction band 23 is removed after crimping of the conductor barrel 21 and the open crimp barrel 22, the distance δ therebetween is maintained. In other words, in the first contact 10, the distance δ between the conductor barrel 21 and the open crimp barrel 22 is defined.

As described above, according to FIGS. 4A and 4B, in the first contact 10 of the present embodiment, an attachment position, relative to the conductor barrel 21 (inner conductor contact), of the open crimp barrel 22 (sleeve) to the dielectric body is certain. In the first contact 10 of the present embodiment, the open crimp barrel 22 (sleeve) can be attached to a defined position relative to the conductor barrel 21 (inner conductor contact). Therefore, variation of VSWR, which is a designed value, can be suppressed.

With reference to FIG. 1, the open crimp barrel 22 is provided with the drop-off preventing means 20, which is provided by knurling processing for example, for preventing drop-off from the dielectric body 9*b*, on an inner wall thereof. As a result, after crimping of the open crimp barrel 22, the drop-off of the open crimp barrel 22 (sleeve) from the dielectric body 9*b* can be prevented. In other words, after defining the attachment position, relative to the conductor barrel (inner conductor contact), of the open crimp barrel 22 (sleeve) to the dielectric body, a positional relationship thereof does not easily vary.

In the contact for coaxial cable according to the present invention, the inner conductor contact, including the contact part and the conductor barrel, and the sleeve for protecting the dielectric body from deformation (after crimping of the open crimp barrel thereto) are integrally configured. As a result, at least any one of ease, reliability and accuracy of attachment to the coaxial cable can be increased.

What is claimed is:

1. A contact for coaxial cable that is attached to an end of a coaxial cable including: an inner conductor disposed in a central portion; a dielectric body that covers the inner conductor; braided wire that covers the dielectric body; and a sheath that covers the braided wire, the contact comprising:

a contact part that is connected to a contact of a corresponding part; and an elongated connection part that extends from a base end portion of the contact part and is connected to the end of the coaxial cable, wherein the connection part includes:

a conductor barrel that is disposed on a side to the base end portion of the contact part and open in a U-shape that can crimp the inner conductor;

an open crimp barrel that is adjacent to the conductor barrel and open in a U-shape that can crimp an exposed portion of the dielectric body so as to surround the exposed portion of the dielectric body in a cylindrical shape; and a junction band that is narrow in width and joins a part of an end edge of the conductor barrel with a part of an end edge of the open crimp barrel so as to form a bridge, and wherein the junction band is formed such that both end portions thereof are tearable during or after crimping of the conductor barrel and the open crimp barrel, so as to separate the conductor barrel and the open crimp barrel.

2. The contact for coaxial cable according to claim 1, wherein a distance between the conductor barrel and the open crimp barrel is defined.

3. The contact for coaxial cable according to claim 1, wherein the open crimp barrel has a drop-off preventing means, which prevents drop-off from the dielectric body, on an inner wall thereof.

4. The contact for coaxial cable according to claim 2, wherein the open crimp barrel has a drop-off preventing means, which prevents drop-off from the dielectric body, on an inner wall thereof.

5. An end processing method for coaxial cable for attaching a contact for coaxial cable to an end of a coaxial cable, the coaxial cable including: an inner conductor disposed in a central portion; a dielectric body that covers the inner conductor; braided wire that covers the dielectric body; and a sheath that covers the braided wire, the contact for coaxial cable including:

a contact part that is connected to a contact of a corresponding part; and an elongated connection part that extends from a base end portion of the contact part and is connected to the end of the coaxial cable, wherein the connection part includes:

a conductor barrel that is disposed on a side to the base end portion of the contact part and open in a U-shape that can crimp the inner conductor;

an open crimp barrel that is adjacent to the conductor barrel and open in a U-shape that can crimp an exposed portion of the dielectric body so as to surround the exposed portion of the dielectric body in a cylindrical shape; and a junction band that joins a part of an end edge of the conductor barrel with a part of an end edge of the open crimp barrel so as to bridge, the end processing method comprising: a cutting and peeling step of measuring the coaxial cable, cutting the end of the coaxial cable, and peeling the dielectric body, the braided wire, and the sheath in a stepped manner, from an end face of the inner conductor to predetermined lengths;

a braided wire folding step of folding back the braided wire so as to cover the sheath; and a crimping and cutting step of cutting both end portions of the junction band during or after crimping of the conductor barrel and the open crimp barrel, so as to separate the conductor barrel and the open crimp barrel.

6. The end processing method for coaxial cable according to claim 5, further comprising: a braided wire recovery step of covering the open crimp barrel in the cylindrical shape, which has been crimped, with the braided wire; and an outer conductor contact attaching step of, using an outer conductor contact having a first crimp part and a second crimp part, crimping the open crimp barrel, which has been crimped over the braided wire, with the first crimp part and the sheath with the second crimp part.

* * * * *